US005949319A

United States Patent [19]

Nuebel et al.

[11] Patent Number: 5,949,319

[45] Date of Patent: Sep. 7, 1999

[54] BAR COIL FOR IGNITION SYSTEMS

[75] Inventors: Karl-Heinz Nuebel, Simmozheim; Wolfgang Endres, Osnabrueck, both of Germany

[73] Assignee: Robert Bosch GmbH, Stuttgart, Germany

[21] Appl. No.: 09/068,400

[22] PCT Filed: Jun. 12, 1997

[86] PCT No.: PCT/DE97/01186

§ 371 Date: May 7, 1998

§ 102(e) Date: May 7, 1998

[87] PCT Pub. No.: WO98/13914

PCT Pub. Date: Apr. 2, 1998

[30] Foreign Application Priority Data

Sep. 26, 1996 [DE] Germany ..... 296 16 780

[51] Int. Cl.[6] ..... H01F 27/02; H01F 27/36; H01F 17/00

[52] U.S. Cl. ..... 336/96; 336/92; 336/84; 336/205

[58] Field of Search ..... 336/92, 96, 107, 336/84 M, 84 C, 84 R, 205, 105; 123/624

[56] References Cited

U.S. PATENT DOCUMENTS

| | | | |
|---|---|---|---|
| 5,101,803 | 4/1992 | Nakamura et al. | 123/634 |
| 5,146,906 | 9/1992 | Agatsuma | 123/634 |

FOREIGN PATENT DOCUMENTS

| | | | |
|---|---|---|---|
| 873327 | 7/1961 | European Pat. Off. | 336/84 |
| 59-74609 | 4/1984 | Japan | 336/84 |

*Primary Examiner*—Michael L. Gellner
*Assistant Examiner*—Anh Mai
*Attorney, Agent, or Firm*—Kenyon & Kenyon

[57] ABSTRACT

A bar coil for use as an ignition coil in internal combustion engines (of motor vehicles) is designed so that casting resin can be introduced into an interior space of the bar coil in a manner that is advantageous from a manufacturing standpoint. The bar coil has a centrally arranged channel that extends from a connecting segment, through a core of the bar coil, and to a pan-shaped bottom area of the interior space of the bar coil. Casting resin flowing through the channel enters the closed bottom area, from which it is diverted as a uniform front to flow through gaps in the bar coil to the connecting segment.

6 Claims, 1 Drawing Sheet

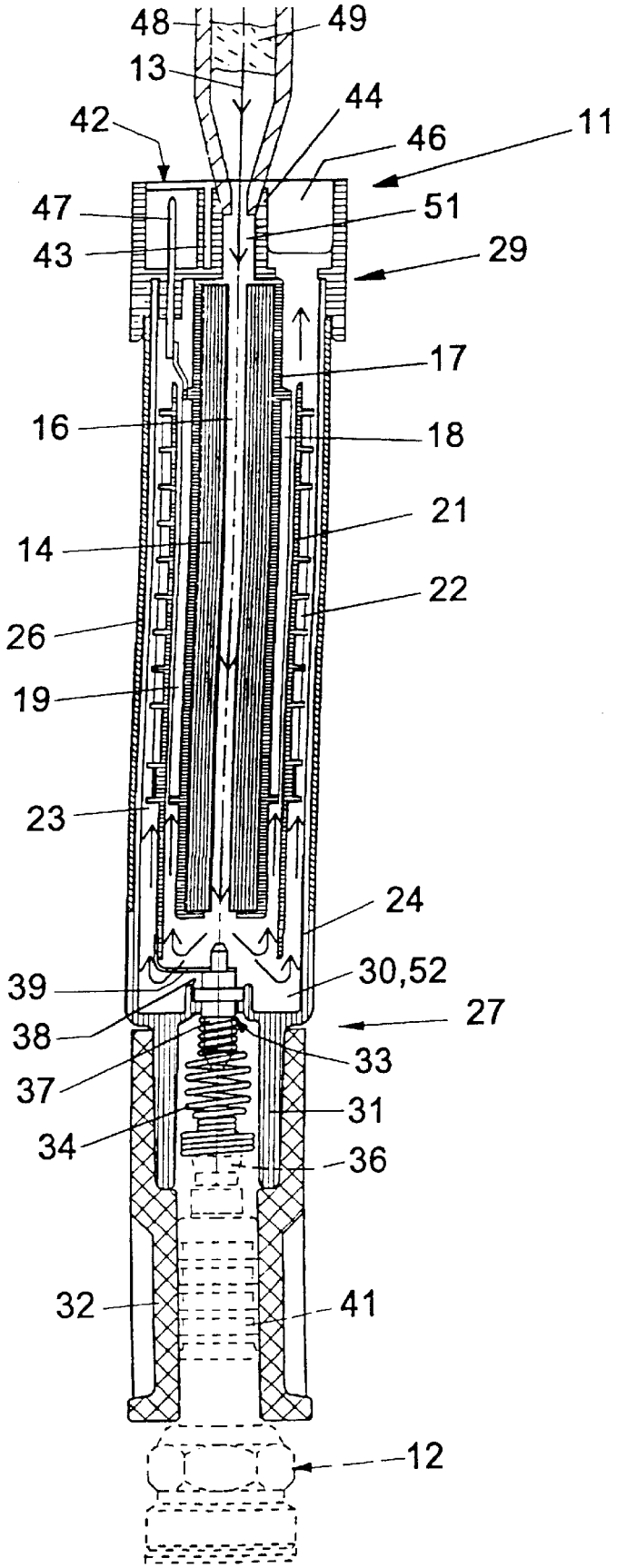
48
49
13
44
42
46
11
47
51
43
29
17
16
18
21
14
22
26
19
23
24
39
30,52
27
38
33
37
31
34
36
32
41
12

BAR COIL FOR IGNITION SYSTEMS

BACKGROUND INFORMATION

German Published Patent Appln. No. DE 41 32 851 A1 discloses a bar coil as the ignition coil unit, having a cylindrical casing in its basic form. A rod-shaped core, a primary winding and a secondary winding, each applied to a separate bobbin, are inside the casing, together with several return plates to influence the magnetic field of the bar coil. These elements are separated from one another by gaps, some of which have a small cross-sectional area and must be filled with casting resin without defects to insulate the elements. The casing is closed at one end with a primary terminal and at the other end with a secondary terminal as the high-voltage terminal, so that it is difficult to add the casting resin.

The narrow gap results in an unfavorable filling time from the manufacturing point of view, and the function is endangered by high-voltage sparkovers due to the possible development of air inclusions.

SUMMARY OF THE INVENTION

The bar coil for ignition systems according to the present invention has the advantage over the related art in that the above-mentioned inadequacy is prevented in a satisfactory manner. For this purpose, the bar coil of the present invention is designed so that casting resin can be introduced directly into the bar coil, downstream of the windings, through a channel which is longer than each of the windings of the bar coil. The casting resin travels from the channel into gaps that are adjacent to the windings.

Thus, the bar coil can be filled rapidly, and the casting resin rises as an essentially uniform front back in the opposite direction through the gaps.

This prevents air inclusions which shorten the insulating clearance after curing as bubbles in the casting resin and can thus lead to failure of the bar coil.

BRIEF DESCRIPTION OF THE DRAWING

The FIGURE shows a longitudinal section through the bar coil.

DETAILED DESCRIPTION

A bar coil 11 that is used as the ignition coil in an internal combustion engines is provided according to the FIGURE for direct contacting with a spark plug 12, which is installed in the usual manner (not shown here) into a shaft in a cylinder head of an internal combustion engine.

Bar coil 11, which is a basically rotationally symmetrical part, has an elongated cylindrical core 14 made of a magnetic material in a coaxial arrangement with longitudinal axis 13, with a central channel 16 running through the core 14.

Concentrically around core 14 there is arranged a first bobbin 17 as the primary bobbin made of plastic, which may be implemented by coating core 14 or as a separately assembled body. Primary winding 18, which carries a low voltage, is applied to the first bobbin 17.

A second bobbin 21 which is provided with secondary winding 22 carrying a high voltage is arranged with a small radial distance as a first gap 19 to primary winding 18.

As an alternative, secondary winding 22 may also be arranged on the inside with primary winding 18 on the outside.

A tubular casing 24 made of plastic follows at a small radial distance (second gap 23) to secondary winding 22. Outside of casing 24, or as an alternative inside the casing 24, is a return element 26 that is provided as a sheet metal part in the form of a jacket to shield the magnetic field of bar coil 11 toward the outside.

At the end of casing 24 there is connected, first, a high-voltage terminal 27 for transferring the ignition power of bar coil 11 to spark plug 12, which is indicated only with dashed lines, and, second, a connecting segment 29. Interior space 30 is formed between casing 24, high-voltage terminal 27 and connecting segment 29.

High-voltage terminal 27 comprises a dome 31, a protective jacket 32, an electrode 33 and a contact spring 34.

Dome 31 is a basically sleeve-shaped plastic part formed as one piece with casing 24, and it is arranged coaxially with longitudinal axis 13. As an alternative, it may also be a plastic part which is separate from casing 24 and surrounds contact spring 34, which is electrically connected to a terminal stud 36 of spark plug 28, and a connection pin 37 of electrode 33, which is designed as a stepped cylinder and is also electrically connected to contact spring 34. Electrode 33 is mounted in a shoulder 38 facing the interior space 30 of dome 31 in such a way that interior space 30 is tightly sealed at this end. Electrode 33 is electrically connected to one end of secondary winding 22 over a contact plate 39 running in interior space 30.

Sleeve-shaped protective jacket 32 is made of silicone rubber that is designed with a stepped shape. Jacket 32 faces spark plug 12 on the outside and is attached over a partial length of dome 31. Further, jacket 32 surrounds an insulator 41 of spark plug 12 and seals the contact area between spark plug 12 and bar coil 11.

Connecting segment 29, which faces in the opposite direction from high-voltage terminal 27, forms the other end of bar coil 11. Connecting segment 29 comprises a primary terminal 42, a separating chamber 43, a filling connection 44 and an equalizing chamber 46. Connecting segment 29 is designed as a one-piece plastic part which is essentially open at the end except for metallic contact elements 47 in primary terminal 42.

Coaxially with longitudinal axis 13 there is arranged filling connection 44, into which a casting nozzle 48 can be inserted for filling interior space 30 with a casting resin 49, which is indicated in the FIGURE. Separating chamber 43 is arranged between filling connection 44 and exterior primary terminal 42, over which a low voltage can be supplied to bar coil 11. Equalizing chamber 46 is mounted on the other side of filling connection 44 on the exterior.

Separating chamber 43, filling connection 44 and equalizing chamber 46 communicate with interior space 30. Thus, an orifice 51, which is provided in filling connection 44, develops into and is aligned with channel 16, which ends in a bottom area 52 of interior space 30. Annular gaps 19, 23 lead from bottom area 52 to equalizing chamber 46 and also (not visible in this diagram) to separating chamber 43.

After assembly of the specified parts, interior space 30 of bar coil 11 is filled with casting resin 49. For this purpose, bar coil 11 is held vertically so that connecting segment 29 is at the top. After tightly inserting casting nozzle 48 into filling connection 44, casting resin 49 is supplied under pressure or under the force of gravity from a storage container (not shown).

Casting resin 49 is first introduced by laminar flow through channel 16, which as an alternative may also be arranged eccentrically and may have different cross-sectional shapes, into bottom area 52, from where it can rise upward as a uniform front.

The filling operation is concluded when casting resin 49 has passed through insulating clearance 19, 23 and reading chambers 43, 46, which thus become partially filled.

To prevent contamination of primary terminal 42 by dripping casting resin 49 when casting nozzle 48 is removed after the filling operation is concluded, separating chamber 43 is provided between filling connection 40 and primary terminal 42. Like equalizing chamber 46, separating chamber 43 also serves as a riser in which a different filling height of casting resin 49 can be established. This is possible due to the volume tolerances of interior space 30.

Various advantages are achieved with the design of bar coil 11 described above for filling with casting resin 49. Due to the laminar flow of casting resin 49 in channel 16, there is no risk of air being entrained due to turbulence. In such a case, after curing of casting resin 49, air inclusions in the form of bubbles would shorten the insulating clearance, which could lead to failure of bar coil 11 due to high-voltage sparkover.

Gaps 19, 23, which are narrow in the area of bobbins 17, 21 and have a high flow resistance, are at the end of the flow path. The casting time, which represents a high cost factor in production of bar coil 11, is therefore much shorter than with a bar coil 11 without channel 16.

Channel 16 yields the possibility of injecting casting resin 49 under pressure. This permits a further reduction in casting time.

Separating chamber 43 prevents drops of casting resin 49 from contaminating primary terminal 42 and contact elements 47. Secondary casting, which was previously necessary to compensate for the slow seepage of casting resin 49, can usually be eliminated.

In summary, a bar coil 11 provides a favorable casting time from the manufacturing point of view, combined with a high manufacturing safety due to the avoidance of air inclusions in casting resin 49.

What is claimed is:

1. A bar coil for use as an ignition coil in an internal combustion engine, comprising:

a core of an open magnetic circuit;

a first bobbin arranged concentrically around the core;

a primary winding arranged on the first bobbin and arranged coaxially with a longitudinal axis of the core;

a second bobbin arranged concentrically around the primary winding and defining a first gap between a surface thereof and the primary winding;

a secondary winding arranged on the second bobbin and arranged coaxially with the longitudinal axis of the core;

a casing arranged concentrically around the secondary winding and defining a second gap between a surface thereof and the secondary winding;

at least one magnetic return element for the magnetic circuit, wherein the at least one magnetic return element is arranged on the casing;

a high-voltage terminal provided at one end of the casing; and a connecting segment provided at another end of the casing, wherein the casing, the high-voltage terminal, and the connecting segment define an interior space of the bar coil, wherein the core includes a channel for filling the bar coil with a casting resin, wherein a longitudinal dimension of the channel is larger than that of the primary winding and that of the secondary winding, and wherein at downstream ends of the primary winding and of the secondary winding the channel is in communication with the first gap and the second gap.

2. The bar coil according to claim 1, wherein the channel, the first gap, and the second gap run between the connecting segment and the high-voltage terminal, and wherein the channel, the first gap, and the second gap define a bottom area at one end of the interior space.

3. The bar coil according to claim 2, wherein the connecting segment includes a filling connection for connecting with a casting nozzle, wherein the filling connection is in communication with the channel, and wherein the casting resin is introduced through the casting nozzle and the filling connection into the channel under an influence of at least one of gravity and pressure.

4. The bar coil according to claim 3, wherein the connecting segment includes a plurality of chambers that are in communication with the first gap and with the second gap, wherein each of the plurality of chambers becomes at least partially filled with the casting resin after the bar coil has been filled with the casting resin.

5. The bar coil according to claim 4, wherein the channel is defined by smooth inner walls of the core, and wherein a flow resistance through the channel is smaller than a sum of a flow resistance through the first gap and a flow resistance through the second gap.

6. The bar coil according to claim 5, wherein the casting resin flows in a laminar flow into the channel, and after passing the bottom area, flows back in an opposite direction through the first gap and the second gap into the plurality of chambers as an essentially uniform flow front.

* * * * *